United States Patent [19]

Tuomi

[11] Patent Number: 4,529,479

[45] Date of Patent: Jul. 16, 1985

[54] METHOD FOR MULTISTAGE BLEACHING AND WASHING WITH RECYCLE OF DISPLACED BLEACHING LIQUOR

[75] Inventor: Alpo Tuomi, Pori, Finland

[73] Assignee: Rauma-Repola Oy, Pori, Finland

[21] Appl. No.: 493,162

[22] Filed: May 10, 1983

[30] Foreign Application Priority Data

May 21, 1982 [FI] Finland ..... 821811

[51] Int. Cl.[3] ..... D21C 3/18; D21C 9/02

[52] U.S. Cl. ..... 162/29; 162/40; 162/60; 162/89

[58] Field of Search ..... 162/88, 89, 60, 29, 162/DIG. 8, 40; 8/156

[56] References Cited

U.S. PATENT DOCUMENTS 4,104,114 8/1978 Rowlandson et al. ..... 162/89

*Primary Examiner*—Steve Alvo

*Attorney, Agent, or Firm*—Burns, Doane, Swecker & Mathis

[57] ABSTRACT

Method and apparatus for pulp bleaching at several bleaching stages by utilizing two or more different bleach chemicals. Bleach chemical (E) is in turn led to the pulp so that it displaces of pulp the chemical used at the preceding stage (C/D, D). Displacing chemical (E) is led to the pulp sheet when on the filtering area of a multi-stage drum washer (1, 2).

2 Claims, 2 Drawing Figures

Figure 1:
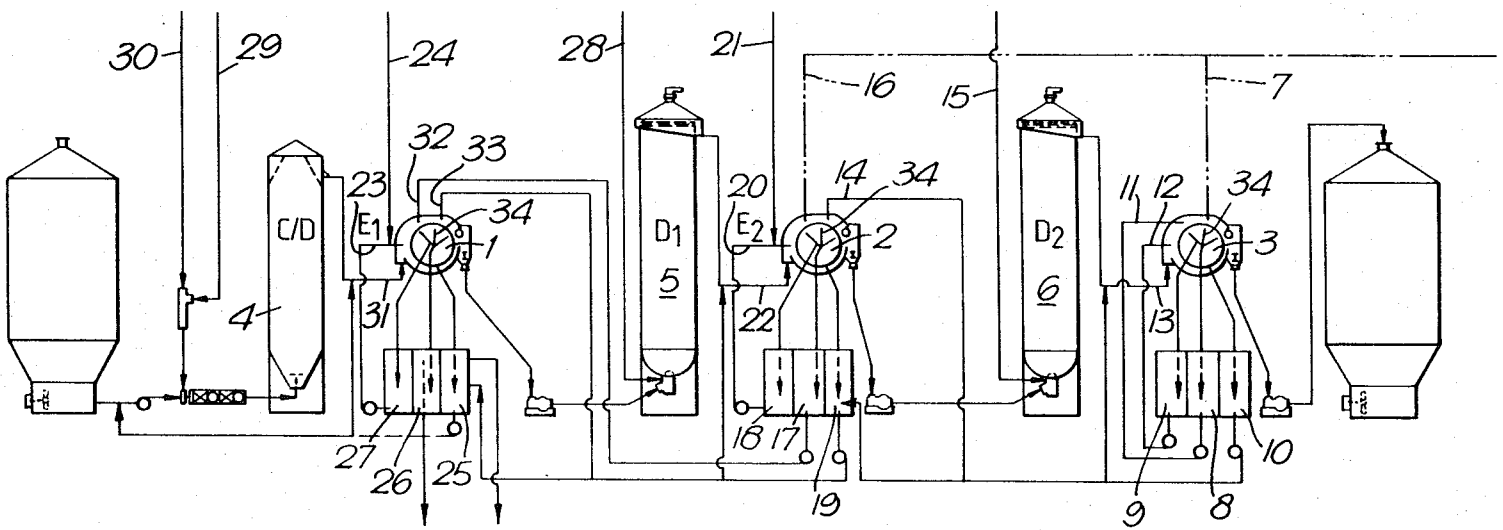

METHOD FOR MULTISTAGE BLEACHING AND WASHING WITH RECYCLE OF DISPLACED BLEACHING LIQUOR

This invention relates to a pulp bleaching process in several stages with two or more bleaching chemicals of different kinds where each bleaching chemical is led to the pulp alternately so that the chemical used in the preceding stage will be displaced from the pulp. The invention also relates to the equipment having most properly one or several consecutive bleaching towers for various bleaching stages.

The system generally used today for bleaching in several stages with two or more bleaching chemicals, e.g. by using first chlorine, chlorine dioxide, alkali and chlorine dioxide again (C/D-E-D-E), utilizes separate reaction towers for each bleaching stage where chemicals mixed with the pulp react with lignin. Between bleaching stages the pulp is washed in drum filters which are one-stage vacuum filters.

The following disadvantages are found to exist in this kind of process:

- A lot of equipment is needed resulting in large installations and expensive investment costs
- Acid and alkaline filtrates coming from different bleaching stages get mixed with each other.
- Different stages generate vapors and gases to be treated
- High steam consumption and bad heat economy
- Because of the vacuum in vacuum filters the temperature level is limited, the maximum temperature being abt. 80° C., at a higher temperature liquids start boiling in the vacuum.

It is known that reaction times, especially those of extraction can be considerably shortened by uniform displacement of the liquid in a pulp sheet with a chemical solution of the next stage instead of mixing. It is further known that the reaction time of the extraction gets shorter when the temperature rises.

The use of multi-stage washer for pulp washing has been known before, i.e. a two-stage pressure washer has been described by the Finnish patent publication Nos. 46534 and 49330. The washer is provided with a vat where a drum rotates partly submerged in stock. The upper part of the drum is located in a pressure chamber above the vat where a higher pressure than inside the drum is prevailing. On the drum outer surface there thickens a uniform pulp sheet which is washed with wash liquid injected through shower pipes. The wash liquid is discharged to the drum interior where liquid collecting equipment is located.

The use of a single liquid collecting equipment involves a two-stage washer. In case the liquid collecting equipment is divided into two sections, the washer operates in three stages.

The main characteristic of the process described in the present invention is the displacing chemical is led to pulp sheet when on the filtering area of a multi-stage drum washer. The equipment of the present invention is characterized by a multi-stage pressure washer installed after one or several bleaching towers and provided with a bleaching chemical pipe at the first stage for leading bleaching chemical into the pulp sheet of the filtering area.

The use of a multi-stage washer for bleaching makes it possible to perform the extraction by displacement, to keep acid and alkaline filtrates away from each other and to properly wash the pulp in the same washer which makes conventional alkali towers unnecessary.

When multi-stage pressure washers are used, particular advantages compared with today's practice can be reached:

- No alkali towers needed
- Fewer separate equipment for washing, etc.
- Low level installation, because no barometric legs are needed for pressure washers
- Savings in installation and investment costs due to the above-mentioned facts
- Better heat economy thanks to closed gas circuits and thermal insulability
- Controlled gas treatment thanks to closed gas circuits
- Higher temperatures can be used, the pressure washer can operate even at boiling point temperatures.

The invention with its details is more particularly described by the following, making references to the attached drawings, where FIG. 1 schematically shows the equipment to apply the process according to the invention by utilizing 3-stage pressure washers.

Figure 2:
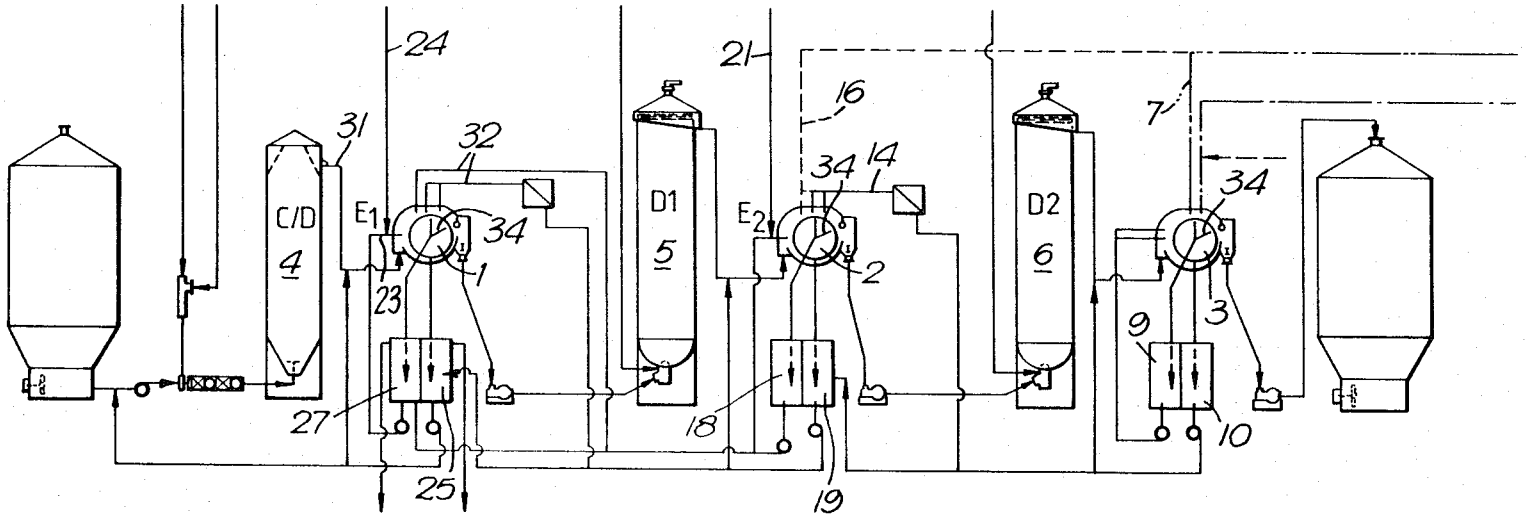

FIG. 2 schematically shows the equipment to apply the process according to the invention by utilizing 2-stage pressure washers.

In the application according to the FIG. 1 the equipment consists of three 3-stage pressure washers 1, 2 and 3 installed after the chlorination tower 4 and chlorine dioxide towers 5 and 6.

In the pressure washers indicated on the drawing the rotation direction of the drum is clockwise. Inside each drum there is located liquid collecting equipment 34 divided into two sections. The first stage 23 of the first washer is provided with shower pipes to spray liquid to the pulp sheet on the drum surface. For dewatering the liquid filtrated in the drum interior during the first stage a pipe is mounted to lead it to the filtrate tank part 25. The second stage 32 of the washer is also provided with shower pipes to spray liquid to the pulp sheet. The liquid displaced at the second stage is collected in the first section of the liquid collecting equipment 34 connected with a pipe to the filtrate tank part 27. The third stage 34 of the washer is also provided with shower pipes.

The liquid displaced at the third stage is collected in the second section of the liquid collecting equipment 34 connected with a pipe to the filtrate tank part 26. The washers 2 and 3 are equivalent in construction, the filtrate tank pertaining to the washer 2 has the parts 18, 17 and 19, the filtrate tank pertaining to the washer 3 has the parts 9, 8 and 10.

The equipment according to the FIG. 1 operates as follows:

Wash water of filtrate used in the washer goes from a filter to another washer against the current therefor of the pulp to be bleached.

Clean wash water 7 is led to the third washing stage of the filter 3. The liquid added in the previous washing stage 11 of the same filter is displaced by it of the pulp sheet on the drum surface and led into the filtrate tank part 8 and pumped to the second washing stage 11 of the filter. The liquid added at the second stage correspondingly displaces the liquid added to the sheet at the first stage 12 which is in turn led to the tank part 9.

The filtrate is further pumped to the first stage 12 where it displaces liquid arrived with pulp 13 from the last chlorine dioxide stage 6. The liquid arrived with pulp 13 and thickened on the filter as well as the liquid displaced at the first washing stage 12 are led from the drum interior to the tank part 10.

In this way the pulp treated at the second chlorine dioxide stage 6 has been effectively washed in 3 stages by unbleached pulp washing.

In this way $ClO_2$-treated pulp can be washed with the lowest possible amount of fresh water.

The strongest, i.e. most acidic filtrate from the tank part 10 is led to the last washing stage 14 of the precedent washer 2 where it displaces the liquid in the pulp sheet and goes with the pulp to the $ClO_2$ tower 6.

$ClO_2$ solution 15 is added to the pulp in a mixer at the bottom of the tower 6 by the method known in bleach plants.

Clean water is used at the second stage 16 of the washer 2, displaced at the last stage and led to the filtrate tank 17. In this way the third (acid) and first (alkali) stages can be separated from each other as effectively as possible. The alkaline filtrate displaced by clean water 16 is led to the tank part 18.

Alkaline filtrate is used at the previously mentioned alkali displacement at the first stage 20 of the multi-stage washer 2.

Addition of alkali (NaOH) 21 to the filtrate is made to adjust pH in the filtrate suitable for extraction.

The liquid arrived with pulp 22 led from the first chlorine dioxide stage 5 and thickened on the washer 2 and the liquid displaced from the pulp sheet during alkali displacement are led to the tank part 19. This liquid mainly comes from the $ClO_2$-treatment 5 and is acidic. In the filtrate tank of the washer 2 there are available:

alkaline filtrate in part 18
nearly neutral filtrate in part 17
acid filtrate in part 19.

To the first multi-stage washer 1 the pulp 31 comes chlorinated from the chlorination tower 4. As described above, the liquid is displaced from of the pulp sheet thickened on the drum at the first stage of the washer with alkaline liquor 23 to which alkali (NaOH) 25 is added to adjust pH.

The liquid thickened of pulp and displaced at the first stage is led from the drum interior to the tank part 25.

The alkaline liquor in the pulp sheet is displaced by nearly neutral filtrate taken from the tank part 17 of the washer 2 at the second washing stage 32 of the washer 1. Displaced at the second washing stage 32 of the washer 1. Displaced alkaline liquid is led to the filtrate tank part 27.

Wash liquid of the second stage is displaced at the last stage 33 of the first washer by acid liquor to be taken from the filtrate tank 19 of the washer 2. Acid liquor follows with in the pulp sheet to the first $ClO_2$-treatment in the tower 5. $Cl_2$ solution 28 is added to the pulp in the mixer ahead of the reaction tower by the method known in bleach plants.

Prior to the chlorination tower 4 $Cl_2$ and $ClO_2$ chemicals have been mixed in to the pulp through the pipes 29 and 30 by the method known in bleach plants.

Temperatures are easy to adjust, e.g. by means of heat exchangers installed in wash filtrate pipes.

The equipment naturally comprises necessary pumps and valves, but they have not been specified above in more details. Moreover the equipment consists of pipe connections by which a part of the filtrate from the first stage can be led to the pulp to be fed to the washer and/or to the corresponding filtrate tank part of the precedent washer. A part of the filtrate from the filtrate tank of the first washer is also fed thereto.

Another application of multi-stage pressure washers for bleaching is the use of 2-stage washers according to the FIG. 2. If 2-stage washers with a single liquid collecting equipment 34 are used, the filtrate tanks connected with washers are also in two parts. Otherwise the equipment is in principle of the same kind as if 3-stage washers were used.

The pulp 31 comes chlorinated from the chlorination stage 4 to the first washer 1 where the pulp is thickened in a uniform sheet on the drum. The first stage 23 of the 2-stage washer 1 is used as alkali displacement/washing stage for which the liquid collected at the second stage 32 is used as displacement liquid and with the alkaline solution 24 (NaOH) being added the pH is adjusted properly for the extraction. Conventional wash filters for the chlorination stage and alkali tower are replaced by the displacement-alkali treatment.

At the second stage 32 of the 2-stage washer 1 washing is carried out with the washing liquid coming from the washer 2 after the following $ClO_2$ bleaching stage 5 so that alkaline filtrate is used for the first washing showers and acid filtrate for the rest. In this way acid and alkaline filtrates can be kept away from each other as effectively as possible.

Corresponding to the above-mentioned description the second extraction stage is also in the 2-stage washer and alternatively replaced by the alkali-displacement-/washing stage in the first stage.

EXAMPLE

The following are typical process values at different bleaching stages when sulphate pulp with a Kappa number of abt. 35 is treated:

1. Chlorination/chlorine dioxide treatment
Pulp consistency: 3%
Temperature: +30° C.
$Cl_2$ dosage: ~5.0% of pulp as active $Cl_2$
$ClO_2$: ~1.0% of pulp as active $Cl_2$
Reaction time: 30 min.
2. First alkali displacement
Pulp consistency: abt. 12%
Temperature: >80° C.
pH: abt. 11
3. First chlorine dioxide stage
Pulp consistency: abt. 10%
Temperature: 70° C.
$ClO_2$ dosage: abt. 2.8% of pulp as active $Cl_2$
Reaction time: 120 min.
4. Second alkali displacement
as in item 2.
5. Second chlorine dioxide stage
Pulp consistency abt. 10%
Temperature: 70° C.
$ClO_2$ dosage: abt. 0.8% of pulp as active $Cl_2$
Reaction time: 120 min.
6. Final washing
Prior to pumping to a storage tank pH to be adjusted with $SO_2$, if necessary. Appropriate range for pH abt. 5.0.

Typical concentrations for chemical solutions:
NaOH abt. 100 g/l, T=20° C.
$ClO_2$ abt. 4–8 g/l, T=5°–10° C.

The invention is not limited only to the above-mentioned examples of applications, but it can vary in different ways within the patent claims. For instance, the bleach chemical solution (C/D-E-D-E-D) described above can be substituted with another combination. Instead of a pressure washer it is possible to use a drum washer of some other type. The displacement can also take place in another washing stage rather than in the first.

I claim:

1. A method for bleaching pulp at several bleaching stages using at least two different bleaching chemicals, with bleaching chemical (E) in turn being brought to the pulp so that it displaces from the pulp the chemical (C/D, D) used in the previous stage, and with the chemical (E) being led to the pulp sheet while the sheet is on the filtering face of a drum washer, the chemical (E) being used at the first stage of the drum and in turn being displaced at the next stage of the drum, characterized in that (a) the drum washer has at least two stages, with at least one of the two stages being subsequent to a previous stage, and is provided with liquid collecting equipment having separate sections arranged inside the drum, so that the bleaching chemical liquid displaced at said subsequent stage of the washer is collected and led partially or completely back to said previous stage of the washer and the liquid displaced at said previous stage of washer is collected and led back upstream with respect to said previous stage of the washer for recycle; and wherein (b) at least two such drum washers of (a) (1,2) are used with at least one of the drum washers being subsequent to a previous drum washer, so that the bleaching chemical liquid displaced at the first stage of said subsequent washer (2) is collected and led partially or completely back to the last stage of said previous washer (1), where it is used as a displacing liquid.

2. A method according to claim 1, characterized in that part of the liquid displaced at said first stage of the subsequent washer (2) is collected in a filtrate tank (19) and then is led to pulp (22) to be fed to the subsequent washer.

* * * * *